US007503395B2

(12) United States Patent
Meijer et al.

(10) Patent No.: US 7,503,395 B2
(45) Date of Patent: Mar. 17, 2009

(54) DOWNHOLE CONNECTION SYSTEM

(75) Inventors: John R. Meijer, Sugar Land, TX (US); Raghuram Kamath, Houston, TX (US); Jason K. Jonas, Missouri City, TX (US); Robert S. Neves, Houston, TX (US); David L. Verzwyvelt, West Columbia, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 344 days.

(21) Appl. No.: 11/383,865

(22) Filed: May 17, 2006

(65) Prior Publication Data

US 2006/0260817 A1 Nov. 23, 2006

Related U.S. Application Data

(60) Provisional application No. 60/595,273, filed on Jun. 20, 2005, provisional application No. 60/683,119, filed on May 21, 2005.

(51) Int. Cl.
*E21B 19/16* (2006.01)

(52) U.S. Cl. ..... 166/380; 166/381; 166/242.7

(58) Field of Classification Search ..... 166/380, 166/381, 242.6, 242.7
See application file for complete search history.

(56) References Cited

U.S. PATENT DOCUMENTS

| | | | | |
|---|---|---|---|---|
| 3,845,450 | A | | 10/1974 | Cole et al. |
| 4,073,562 | A | * | 2/1978 | Karlskind ..... 439/199 |
| 4,373,767 | A | | 2/1983 | Cairns |
| 4,606,603 | A | | 8/1986 | Cairns |
| 4,616,900 | A | | 10/1986 | Cairns |
| 4,666,242 | A | | 5/1987 | Cairns |
| 4,682,848 | A | | 7/1987 | Cairns et al. |
| 4,696,540 | A | | 9/1987 | Adams et al. |
| 4,720,124 | A | | 1/1988 | Taylor et al. |
| 4,795,359 | A | | 1/1989 | Alcock et al. |
| 4,948,377 | A | | 8/1990 | Cairns |
| 5,194,012 | A | | 3/1993 | Cairns |
| 5,203,805 | A | | 4/1993 | Cairns |
| 5,640,477 | A | | 6/1997 | Anderson |
| 5,838,857 | A | | 11/1998 | Niekrasz |
| 5,899,765 | A | | 5/1999 | Niekrasz et al. |
| 6,186,229 | B1 | | 2/2001 | Martin et al. |
| 6,390,193 | B1 | | 5/2002 | Martin et al. |
| 6,409,175 | B1 | | 6/2002 | Evans et al. |
| 6,666,400 | B2 | | 12/2003 | White, III |
| 6,736,547 | B2 | | 5/2004 | Stevens et al. |

(Continued)

FOREIGN PATENT DOCUMENTS

EP 0957233 A3 11/2000

(Continued)

*Primary Examiner*—Giovanna C Wright
(74) *Attorney, Agent, or Firm*—James L. Kurka; Daryl R. Wright; Robert Van Someren

(57) ABSTRACT

A technique is provided to facilitate connection of well equipment assemblies at a downhole location. A first assembly comprises a control line having a connector designed for coupling with a corresponding connector of a next adjacent assembly. Additionally, a mechanism is provided to restrain movement of the next adjacent assembly prior to full engagement with the first assembly to enable performance of a desired preparation procedure.

25 Claims, 15 Drawing Sheets

U.S. PATENT DOCUMENTS

| | | | | |
|---|---|---|---|---|
| 6,929,404 | B2 | 8/2005 | Jones et al. | |
| 6,966,384 | B2 | 11/2005 | Griffiths | |
| 6,968,618 | B2 | 11/2005 | Cook et al. | |
| 6,983,796 | B2 | 1/2006 | Bayne et al. | |
| 7,080,996 | B2 * | 7/2006 | Ostergaard | 439/188 |
| 2005/0072564 | A1 | 4/2005 | Grigsby et al. | |
| 2005/0230104 | A1 | 10/2005 | Cook et al. | |

FOREIGN PATENT DOCUMENTS

| | | | |
|---|---|---|---|
| EP | 0682276 | B1 | 2/2002 |
| EP | 0927375 | B1 | 2/2002 |
| EP | 0772063 | B1 | 7/2002 |
| EP | 0690320 | B1 | 10/2002 |
| EP | 1312954 | A1 | 5/2003 |
| EP | 0940699 | B1 | 5/2004 |
| EP | 1524536 | A1 | 4/2005 |
| EP | 1600600 | A2 | 11/2005 |
| GB | 2355740 | A | 5/2001 |
| GB | 2400390 | A | 10/2004 |
| GB | 2404017 | A | 1/2005 |
| GB | 2407649 | A | 5/2005 |
| GB | 2413399 | A | 10/2005 |
| WO | 01/44847 | A1 | 6/2001 |
| WO | 2004/102236 | A2 | 11/2004 |
| WO | 2004/104536 | A1 | 12/2004 |
| WO | 2005/045175 | A2 | 5/2005 |
| WO | 2006/003208 | A1 | 1/2006 |

* cited by examiner

DOWNHOLE CONNECTION SYSTEM

CROSS-REFERENCE TO RELATED APPLICATION

The present document is based on and claims priority to U.S. provisional application Ser. No. 60/683,119, filed May 21, 2005 and U.S. provisional application Ser. No. 60/595,273, filed Jun. 20, 2005.

BACKGROUND

Many types of wells, e.g. oil and gas wells, are completed in two or more stages. For example, a lower completion assembly may be moved downhole initially on a running string. After deployment of the lower completion assembly at a desired location in the wellbore, an upper completion assembly is deployed downhole and engaged with the lower completion assembly.

Many well completions incorporate one or more control lines, such as optical, electrical or fluid control lines, to carry signals to or from components of the downhole completion. The completion of wells in two or more stages, however, can create difficulties in forming dependable and repeatable control line connections between adjacent completion assemblies.

The use of control lines may be complicated further by certain components utilized in the downhole completion as well as certain conditions found in the downhole environment. For example, debris and other contaminants can interfere with the formation of control line connections between completion assemblies. Additionally, components, e.g. expansion/contraction joints, utilized in downhole completions can have detrimental shortcomings, including the creation of difficulties in routing control lines.

With respect to expansion/contraction joints, such joints enable changes or variations in the length of various downhole completion sections while still providing sufficient strength along the axis of the completion. A contraction joint typically comprises an upper and a lower section that are able to move in relation to each other while maintaining continuity and structural integrity. However, shortcomings of existing expansion/contraction joints include, for example, lack of control line passages for routing control lines, limited ability to reset, inability to isolate pressure, unknown variation in the overall length while being transported downhole, and limited functionality due to reliance on shear mechanisms.

SUMMARY

In general, the present invention provides a technique for forming a downhole completion by connecting completion assemblies at a downhole location. A first or lower assembly is moved downhole to a desired location within a wellbore. The lower assembly comprises a control line connector for receiving a corresponding control line connector of a second or upper assembly when the upper assembly is engaged with, e.g. stabbed into, the lower assembly. Additionally, a mechanism is utilized to selectively restrain engagement of the second assembly with the first assembly during a desired procedure, such as a clean out procedure proximate the control line connector.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a technique that facilitates coupling of well equipment assemblies within a wellbore at a desired downhole location. For example, the system enables the deployment of a lower assembly in a wellbore and the subsequent engagement of an upper assembly and one or more control lines. For example, one embodiment of the present invention comprises a system capable of deploying and connecting a fixed fiber optic sensor network in a two stage completion. In this monument, once the connection is established, a continuous optical path is obtained that starts from the surface and runs to the bottom of an open hole formation and back to the surface to complete an optical loop. The connection also may be established for other control lines, such as electrical control lines or fluid control lines in various combinations. The control line connections may be established, broken and reestablished repeatedly. This type of system may be used for land, offshore platform, or subsea deployments in a variety of environments and with a variety of downhole components. For example, the system may utilize fiber sensing systems and the deployment of fiber optic sensors in sand control components, perforating components, formation fracturing components, flow control components, or other components used in well drilling, completion, maintenance or production operations.

Figure 1:
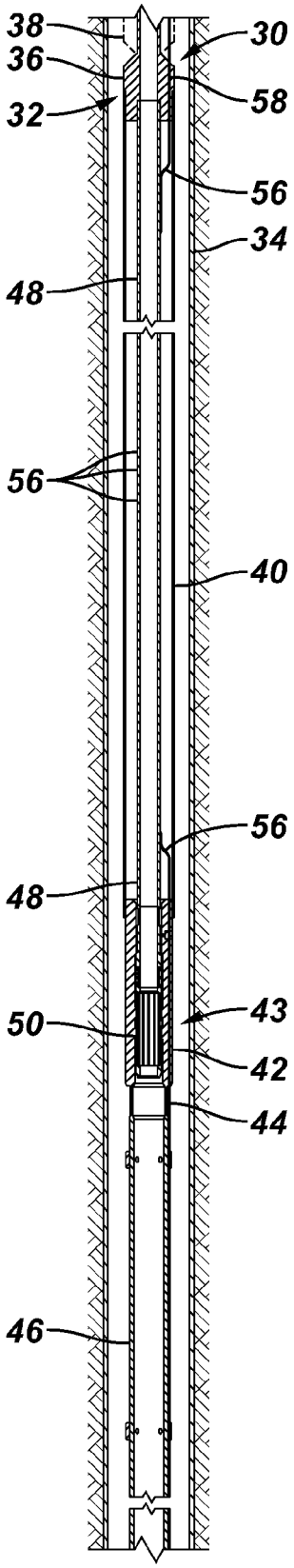
FIG. 1 is a schematic view of a wellbore with a completion having a contraction joint, according to an embodiment of the present invention.
Figure 2:
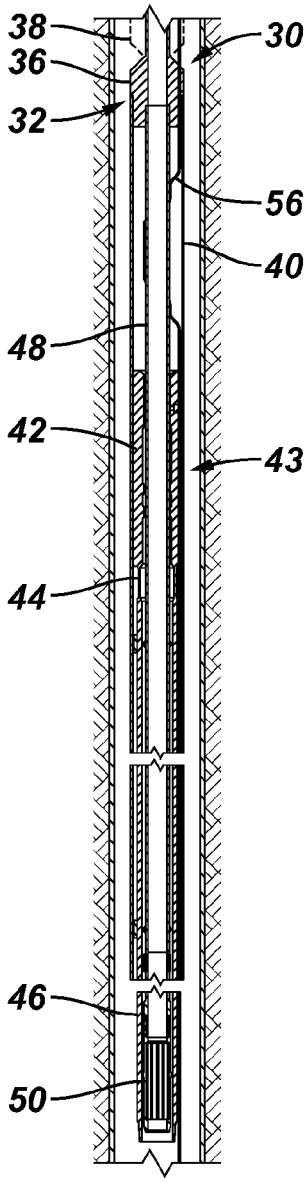
FIG. 2 is a schematic view similar to that of FIG. 1 but showing the contraction joint in a contracted configuration, according to an embodiment of the present invention.

By way of further example, an embodiment of the present invention may comprise a well operation system for installation in a well in two or more stages. The well operation system may comprise a lower assembly, an upper assembly, a connector for connecting a control line in the upper assembly to a corresponding control line in the lower assembly, and a contraction joint able to provide length compensation for the control line and the tubulars. The connection system and methodology described herein can be used to connect a variety of downhole control lines, including communication lines, power lines, electrical lines, fiber optic lines, hydraulic conduits and other control lines. Additionally, the upper and lower assemblies may comprise a variety of components and assemblies for multistage well operations, including completion assemblies, drilling assemblies, well testing assemblies, well intervention assemblies, production assemblies and other assemblies used in various well operations. With respect to specific components, the upper and lower assemblies may include tubing, casing, liner hangers, formation isolation valves, safety valves, other well flow/control valves, perforating and other formation fracturing tools, well sealing elements, e.g. packers, polished bore receptacles, sand control components, e.g. sand screens and gravel packing tools, artificial lift mechanisms, e.g. pumps or gas lift valves and related accessories, drilling tools, bottom hole assemblies, diverter tools, running tools and other downhole components. It should be noted that in this description the term "lower" also can refer to the first or lead equipment/assembly moved downhole, and the term "upper" can refer to the second or later equipment/assembly moved downhole into engagement with the "lower" unit. In a horizontal wellbore, for example, the lower equipment/assembly is the equipment/assembly run downhole first, i.e. prior to the upper equipment/assembly Referring generally to FIG. 1, a portion of a connection system 30 is illustrated in the form of a contraction joint 32 to provide for changes or variations in the length of various downhole assembly sections while providing sufficient strength along the axis of system 30. The contraction joint 32 also is designed to accommodate the presence of one or more control lines during changes or variations in length. In the embodiment illustrated, contraction joint 32 is located in a wellbore 34 and comprises an upper crossover 36 for mating the contraction joint 32 with an uphole component 38 of, for example, an upper completion. A shroud 40 extends from the upper crossover 36 to a housing 42 of a contraction joint restraint mechanism 43, such as a collet assembly. A lower crossover component 44 couples the contraction joint 32 with a downhole component 46 of, for example, a downhole completion. The contraction joint 32 also includes an inner tubing 48 located within shroud 40. In the embodiment illustrated, contraction joint restraint mechanism 43 comprises a collet assembly, and inner tubing 48 is connected to a deformable collet 50 located at the lower end of inner tubing 48. The contraction joint restraint mechanism 43 enables selective actuation of the contraction joint 32 from a fully extended position to less than fully extended, i.e. contracted, position, as illustrated in FIG. 2.

Figure 3:
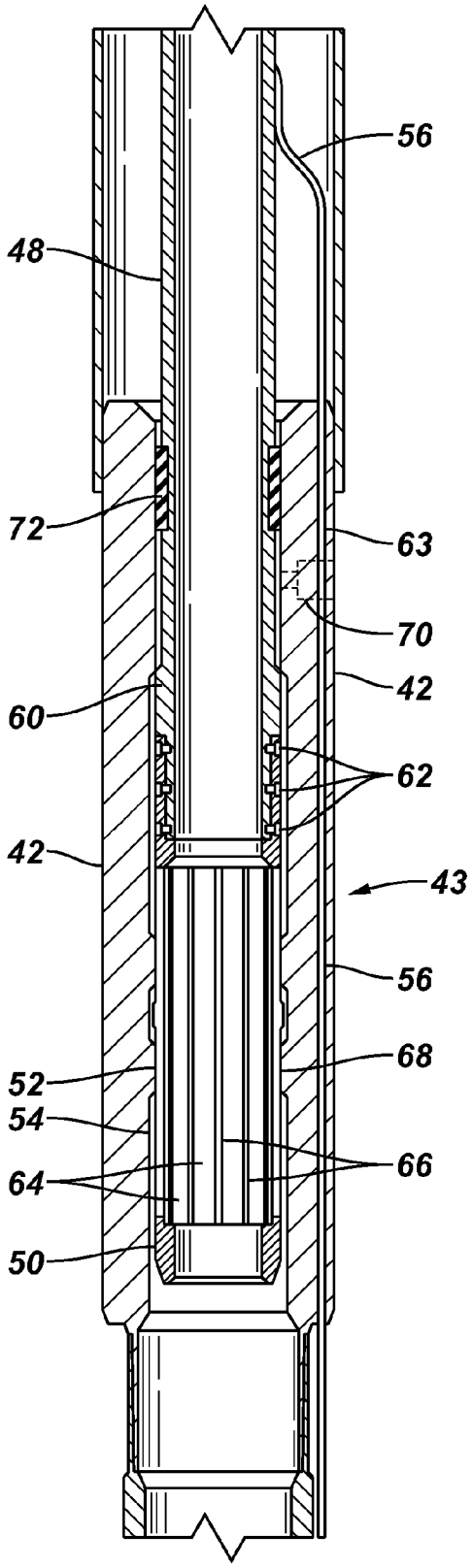
FIG. 3 is an enlarged view of a portion of the contraction joint illustrating a collet assembly, according to an embodiment of the present invention.

Collet 50 is configured to enable deformation in a radial direction and comprises an outer surface profile 52 that corresponds to an inner surface profile 54 of housing 42, as illustrated in FIG. 3. When contraction joint 32 is fully expanded, the collet 50 mates with housing 42, e.g. with the collet housing, to hold the contraction joint 32 in a locked, extended position. However, upon application of a sufficient downward force, the collet 50 is flexed inwardly and moved downward with respect to the housing 42. Once the collet 50 is disengaged from housing 42, the inner tubing 48 is relatively free to move axially within housing 42. In this movable or unlocked position, the shroud 40 also moves along with the inner tubing, but across the outer surface of housing 42 (see FIG. 2). Corresponding lugs and slots or other anti-rotation mechanisms can be used to limit or prevent the relative rotation of contraction joint components while allowing expansion and contraction of the joint.

One or more control lines 56 may be housed within or along the contraction joint 32. For example, the one or more control lines 56 may extend from an uphole location, through upper crossover 36, along contraction joint 32 and through lower crossover component 44, as illustrated in FIGS. 1 and 2. The one or more control lines 56 may be wound circumferentially around the outer surface of inner tubing 48 to accommodate for expansion and contraction of contraction joint 32. By way of example, the one or more control lines 56 may comprise optical cables, electrical conductors and/or flexible hydraulic conduits.

The components of contraction joint 32 may be connected using various techniques. For example, shroud 40 may be attached to upper crossover 36 via one or more set screws, and inner tubing 48 may be attached to upper crossover 36 by a threaded engagement. The shroud 40 is connected in a manner to provide a sufficient distance between the inner surface of the shroud and the outer surface of inner tubing 48 to allow space for the circumferential coiling of control line 56, thereby providing protection for the control line. Furthermore, upper crossover 36 may be formed with a pathway 58, such as a drilled pathway or a surface channel, for routing the one or more control lines 56 therethrough. At the lower end of contraction joint 32, the inner tubing 48 may be threaded to an internal crossover 60 which, in turn, is attached to collet 50 by one or more set screws 62. The one or more control lines 56 may be routed along a pathway 63, e.g. drilled pathway or surface channel, formed along housing 42.

As illustrated in FIG. 3, collet 50 may comprise a plurality of fingers 64 separated by slots 66 oriented longitudinally along a substantial length of collet 50. The slots 66 may be in the form of channels extending partially or completely through the radial thickness of the collet. The slots 66 allow the outer diameter of the collet 50 to collapse upon application of sufficient force. When fully expanded, or when in a steady expanded state, the outer surface of the collet 50 expands to the inner surface profile of housing 42 which serves as a latching mechanism 68 for restraining collet 50 and thus holding contraction joint 32 in its fully extended position. The use of a contraction joint restraint mechanism 43, such as collet 50 and latch mechanism 68, provides a contraction joint that is positively resettable. In other words, contraction joint 32 can be reset to its fully extended position multiple times. The contraction joint restraint mechanism 43 further provides a positive indication of the position of the contraction joint. It should be noted that restraint mechanism 43 may further include an optional shear member 70, such as a shear pin, to hold contraction joint 32 in its fully extended position during the initial run downhole. Also, the profiles selected for latch mechanism 68 and the exterior of collet 50 are not restricted to those illustrated, and other profiles can be implemented to achieve or enhance various operational features. For example, the angles and lengths of the mating profiles are subject to change based on force requirements determined for a particular application.

The middle portion of contraction joint 32 also comprises a seal arrangement 72 comprising one or more seals to maintain a seal along inner tubing 48 even when contraction joint 32 is in its fully extended position. The seals of seal arrangement 72 may be constructed in a variety of forms and configurations, including o-rings, bonded seals, v-stacks and other seal designs and arrangements. In the embodiment illustrated, seal arrangement 72 is disposed between internal crossover 60 and housing 42 when contraction joint 32 is in its fully extended position. In this way, hydraulic pressure applied within inner tubing 48 is fully transmitted downhole below housing 42. Also, the ability of the seal arrangement 72 to hold pressure while the contraction joint 32 is in a fully extended position prevents backflow of pressure through slots 66 of collet 50 into the annular region between inner tubing 48 and housing 42 and to the outside annulus between the tubing string and the casing. This enables initiation of and/or control over an operation occurring below the contraction joint via application of hydraulic pressure. For example, a downhole control line connection may be actuated with hydraulic pressure applied to the inside of the tubing string through the contraction joint 32 when the contraction joint is in the extended position.

To activate contraction joint 32, a downward force is applied to release collet 50 from housing 42. The latching mechanism or inner profile of housing 42 directs the downwardly applied force in a radially inward direction on collet fingers 64. The collet 50 is collapsed from a radially expanded position to position having a reduced diameter to enable movement of collet 50 out of the locking engagement with latch mechanism 68 formed by the inner profile of housing 42. Once disengaged, collet 50, inner tubing 48 and shroud 40 are allowed to move in a downward direction. In the embodiment illustrated, the inner profile of housing 42 is designed to prevent upward movement of collet 50 above housing 42. However, contraction joint 32 and the inner profile of housing 42 can be designed to enable movement of collet 50 both above and below housing 42 by, for example, changing the inner profile of housing 42 and extending inner tubing 48 below collet 50.

When in the disengaged position, sealing arrangement 72 no longer isolates pressure to the interior of inner tubing 48, at least in the embodiment illustrated. As inner tubing 48 moves downward, sealing arrangement 72 travels with inner tubing 48 and reaches a section of the inner housing profile having a larger diameter which is not contacted by the seals of seal arrangement 72. In other embodiments, however, pressure isolation may be maintained even when collet 50 is disengaged by extending the length of the seal contact surface.

By way of one example, contraction joint 32 may be used in a dual stage coupling operation in which a control line is also connected downhole. Initially, a lower completion is deployed downhole. Subsequently, an upper completion is run downhole and landed in the lower completion by slacking off a predetermined amount of weight but not so much as to disengage collet 50 from housing 42. The control line connection is then formed, followed by the slacking off of an additional predetermined amount of weight to mechanically actuate contraction joint 32 to a contracted position by moving collet 50 past housing 42. In this specific example, a subsea tubing hanger is then landed. If necessary, however, contraction joint 32 can be reset prior to landing the tubing hanger by picking up on the contraction joint until a predetermined overpull is measured. The predetermined overpull provides a positive indication of the position of the contraction joint in its fully extended position.

Figure 4:
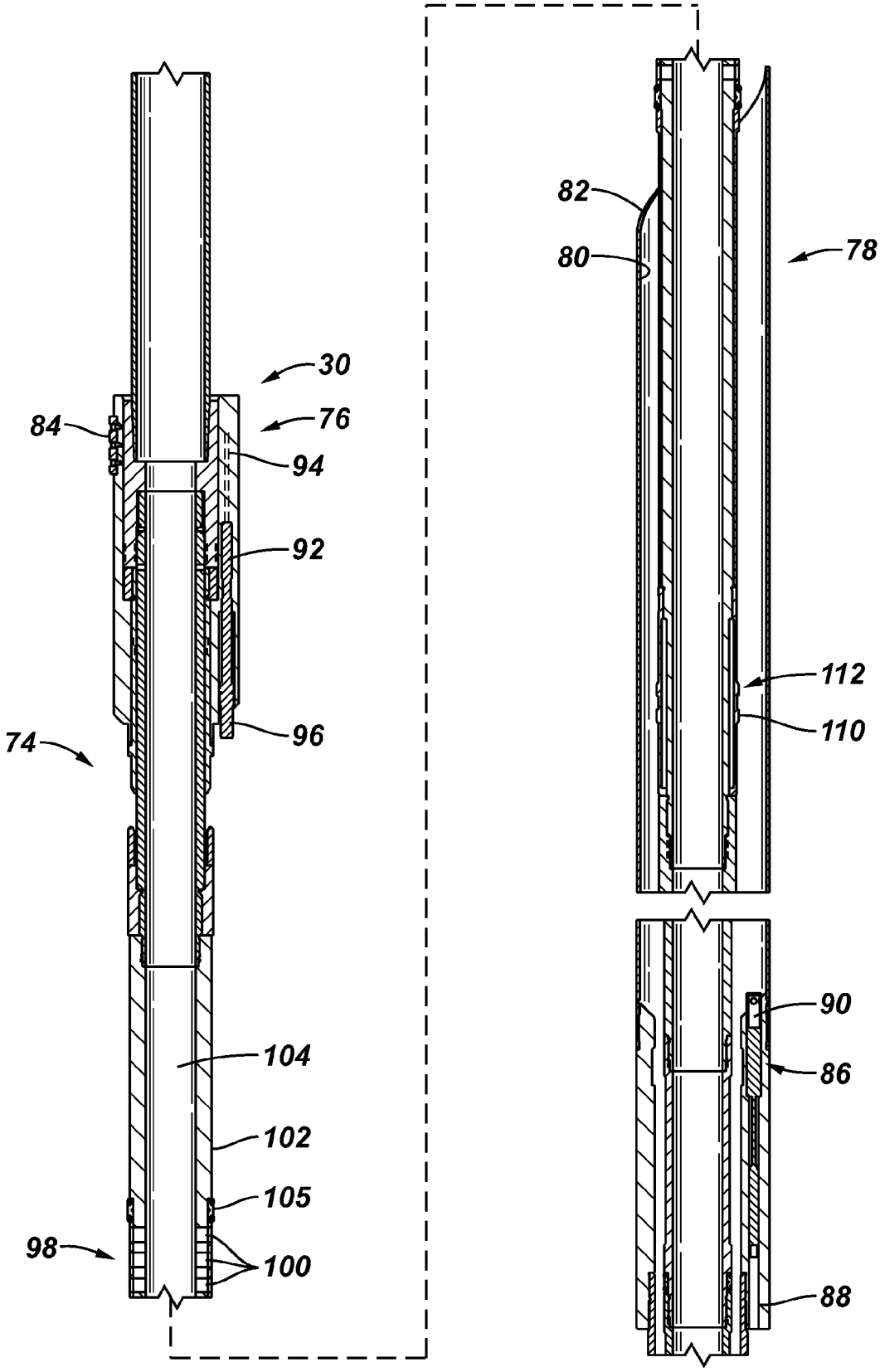
FIG. 4 is an illustration of an upper well equipment assembly being engaged with, e.g. stabbed into, a lower well equipment 1 assembly, according to an embodiment of the present invention.

System 30 may comprise other components, such as a connector system 74, as illustrated in FIG. 4. Connector system 74 is designed to enable the coupling of control line segments at a downhole location. In the embodiment illustrated, an upper assembly 76 is designed to engage a lower assembly 78. For example, upper assembly 76 may be designed to stab into a receptacle 80 of lower assembly 78, as illustrated in FIG. 4. In the embodiment illustrated, lower assembly 78 comprises an alignment receiver 82, such as a helical surface, and upper assembly 76 comprises an alignment key 84 positioned to engage alignment receiver 82 for rotational alignment of upper assembly 76 as the upper assembly moves into lower assembly 78. By way of example, the upper assembly 76 may comprise a snap-latch style production seal assembly augmented with a swiveling carrier.

Lower assembly 78 further comprises a lower control line connector 86 to which a control line segment 88 may be connected. Control line segment 88 may comprise a fiber optic line, an electrical line, a fluid conduit or other type of control line for which a downhole connection is desired. Additionally, lower assembly 78 may comprise a plurality of lower control line connectors and control line segments of the same or differing types of control lines. In the embodiment illustrated, lower control line connector 86 comprises a receptacle 90.

Upper assembly 76 comprises an upper control line connector 92 to which a control line segment 94 may be connected. Control line segment 94 may comprise a fiber optic line, an electrical line, a fluid conduit or other type of control line suitable for coupling with control line segment 88 of lower assembly 78. Additionally, upper assembly 76 may comprise a plurality of upper control line connectors and control line segments of the same or differing types of control lines. In the embodiment illustrated, upper control line connector 92 comprises an extension 96 sized for receipt in receptacle 90. It should be noted, however, that the extension and receptacle can be on the lower assembly and the upper assembly, respectively, and other forms and arrangements of connector assemblies can be used.

Upper assembly 76 also comprises a flushing mechanism 98 having at least one port 100 and often a plurality of ports 100 through which a flushing fluid, such as a clean-out fluid or gel, is flowed. As illustrated, ports 100 may be formed in a generally radial direction through a tubing 102 of upper assembly 76. Tubing 102 can be used, for example, for the production of well fluids, but it also can be used for the injection of fluids, such as flushing fluids. For example, flushing fluids can be pumped downwardly through an interior 104 of tubing 102 and out through ports 100 to flush, e.g. clean, a specific region of system 30. In one embodiment, flushing fluid is flowed through ports 100 to clean lower control line connector 86 and/or upper control line connector 92 prior to engagement of the connectors. The flushing mechanism 98 also can be used to provide a positive indication of the position of upper assembly 76. When both sets of seals 105 move past lower control line connector 86 (see FIG. 5), the pressure of flushing fluid increases and indicates the relative positions of the upper and lower assemblies. If desired, the upper assembly can then be raised to flush the region.

Figure 5:
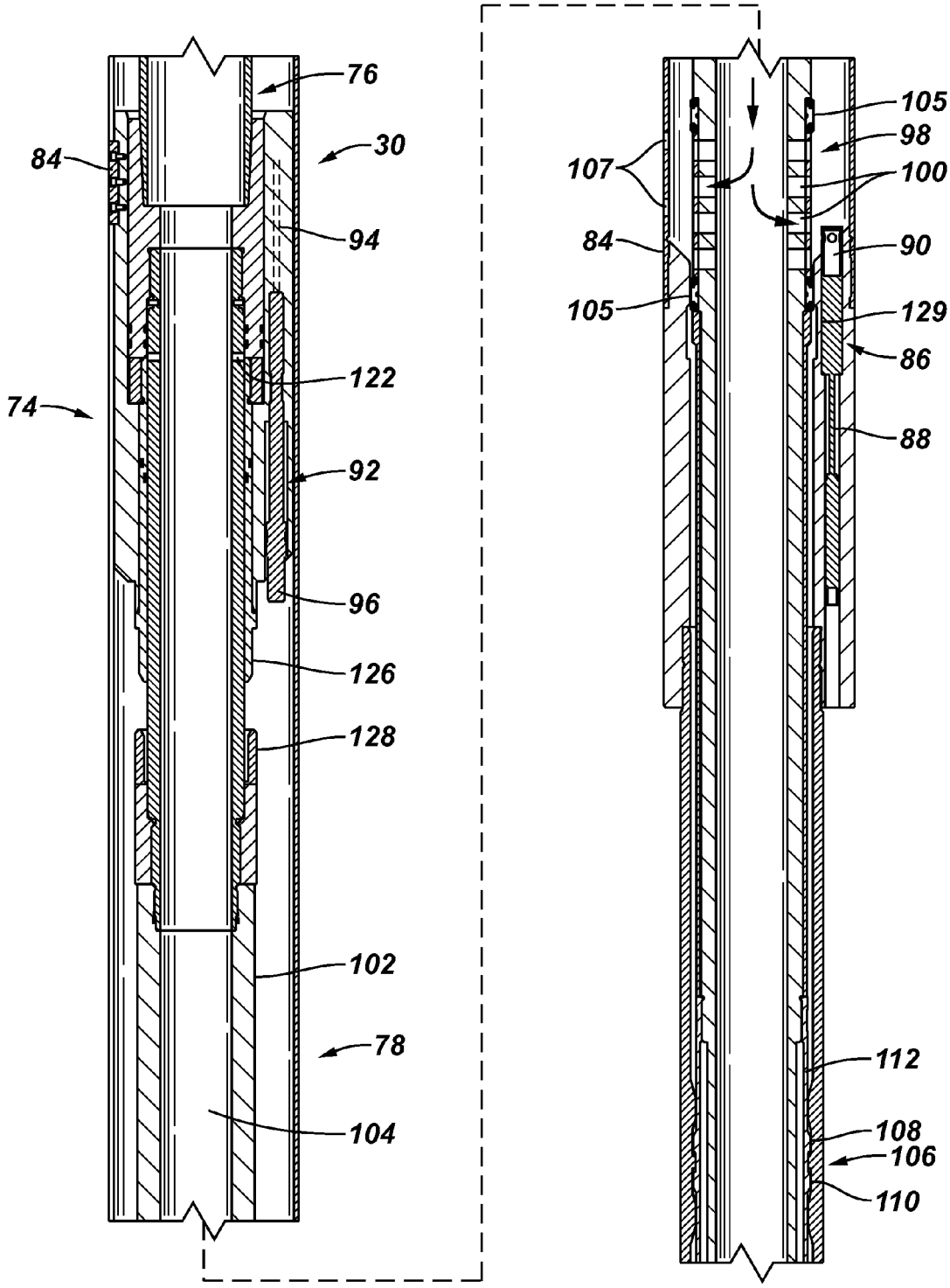
FIG. 5 is another illustration of an upper well equipment assembly being engaged with a lower well equipment assembly, according to an embodiment of the present invention.

As illustrated in FIG. 5, movement of upper assembly 76 into lower assembly 78 can be restrained by a latch mechanism 106 while a flushing fluid is flowed past lower control line connector 86 to clean the region of debris or other contaminants prior to coupling lower control line connector 86 with upper control line connector 92. The debris or other contaminants can be removed into the well via debris ports 107. In this example, latch mechanism 106 comprises a profile 108 formed on an interior of lower assembly 78 for engagement with a corresponding engagement portion, e.g. profile, 110 on tubing 102 of upper assembly 76. The corresponding profile 110 may be formed with a collet 112 that engages profile 108 to restrain further engagement of the upper and lower assemblies during flushing of the connector region.

Figure 6:
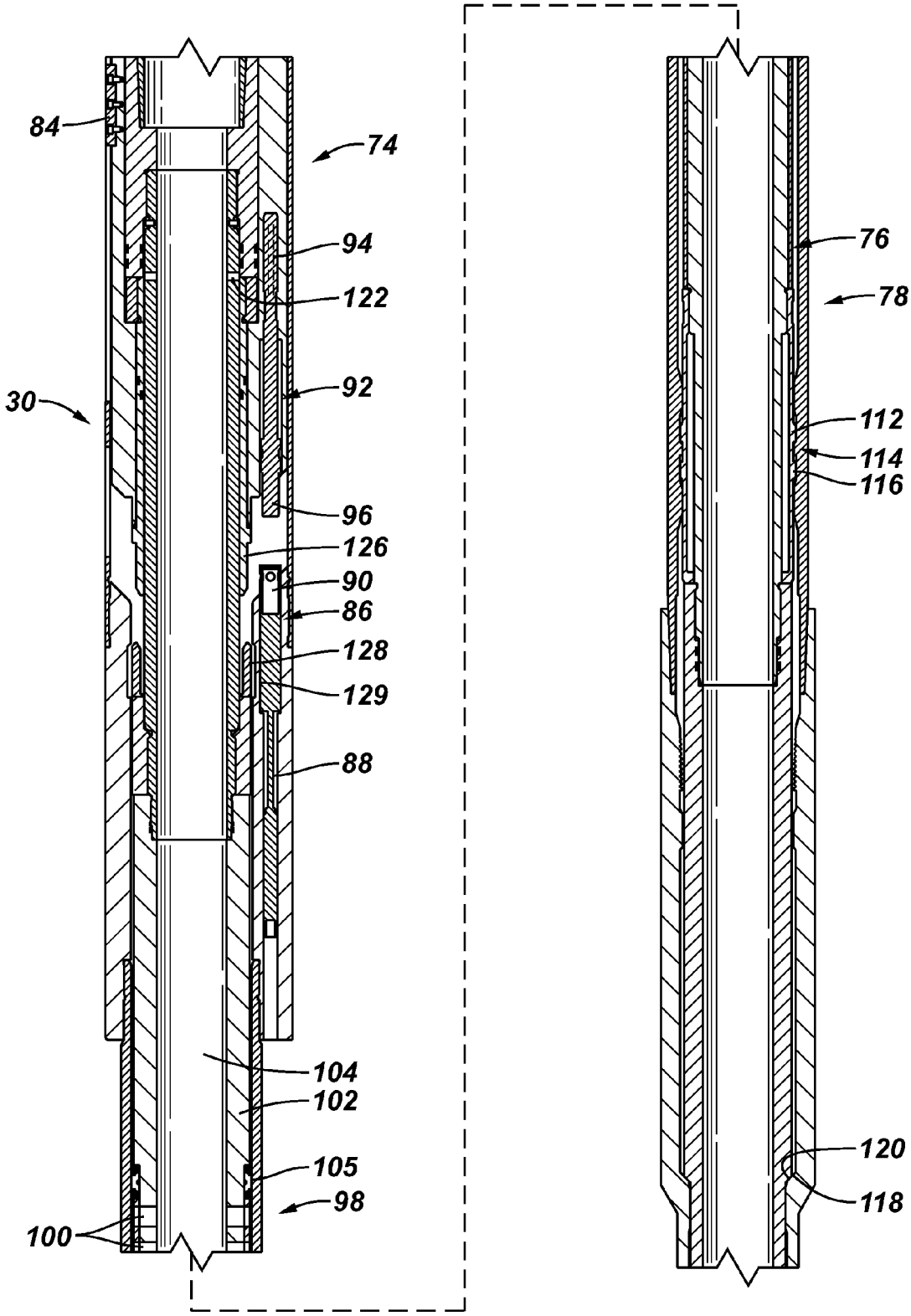
FIG. 6 is another illustration of an upper well equipment assembly being engaged with a lower well equipment assembly, according to an embodiment of the present invention.

Following the flushing procedure, collet 112 is forced through profile 108 as the upper assembly 76 is further engaged with lower assembly 78. The upper assembly 76 is moved into lower assembly 78 until collet 112 engages a second latch mechanism 114 having a profile 116 designed to secure the outer profile of collet 112, as illustrated in FIG. 6. The second latch mechanism 114 is spaced longitudinally from the first latch mechanism 106 and is located to position upper control line connector 92 in relatively close proximity with lower control line connector 86. Additionally, lower assembly 78 may comprise a shoulder 118 positioned to engage a corresponding shoulder 120 of upper assembly 76 to stop further insertion of upper assembly 76 into lower assembly 78. Collet 112 comprises a single collet or a plurality of collets, e.g. two collets, captured by appropriately located corresponding latch mechanisms. For example, collet 112 may be two collets located to sequentially engage first latch mechanism 106 and second latch mechanism 114.

Figure 7:
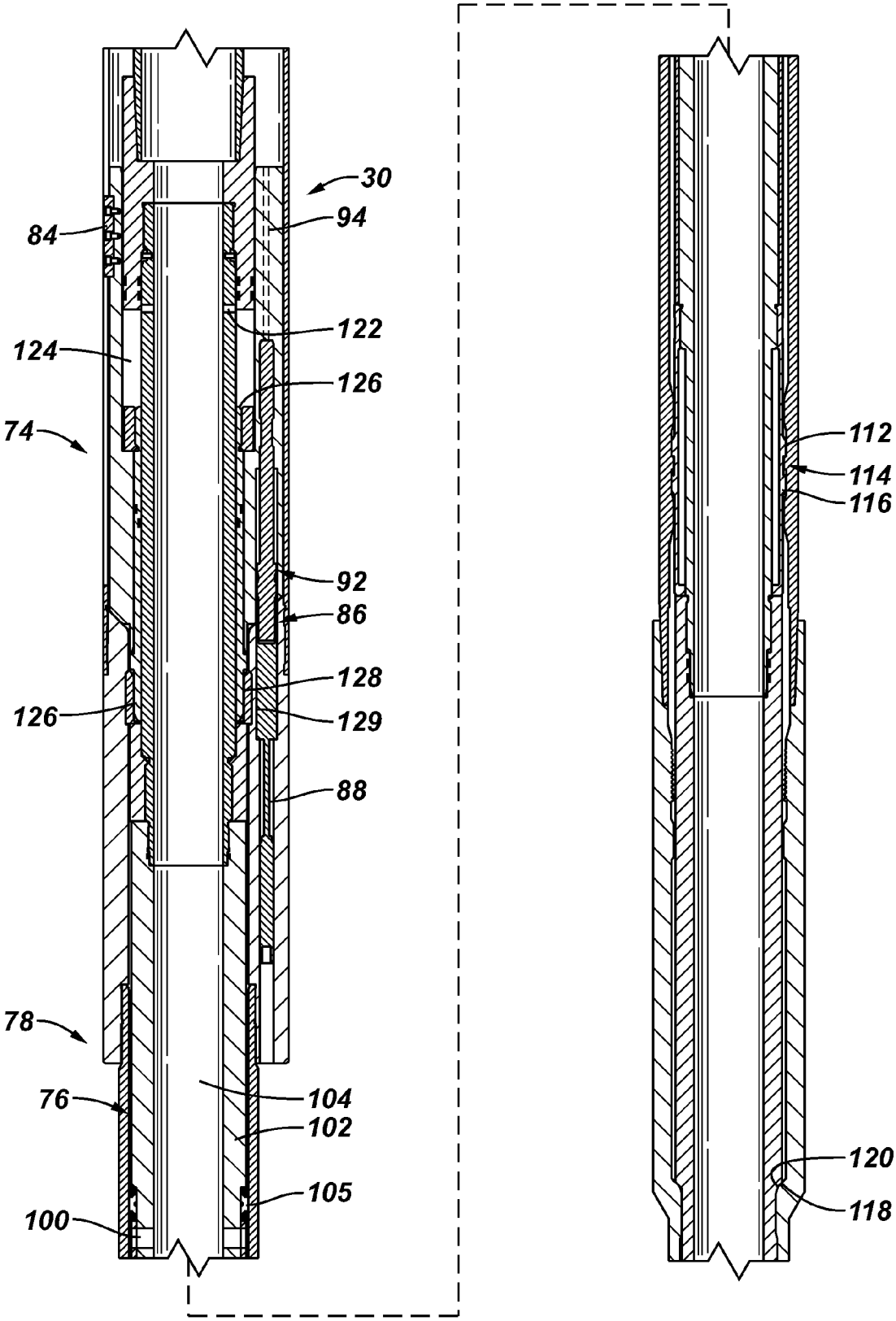
FIG. 7 is an illustration of an upper well equipment assembly engaged with a lower well equipment assembly, according to an embodiment of the present invention.

Once connector system 74 is positioned at the second latch mechanism 114, upper control line connector 92 can be brought into engagement with, i.e. coupled with, lower control line connector 86 by a variety of mechanisms. For example, connector 92 can be moved into engagement with connector 86 by applying tubing pressure within interior 104 of tubing 102. In this embodiment, pressurized fluid is directed through ports 122, into a piston chamber 124 and against a piston 126 that is coupled to upper control line connector 92, as further illustrated in FIG. 7. Upon application of sufficient pressure, piston 126 is moved downwardly. The movement of piston 126 forces extension 96 of upper control line connector 92 into receptacle 90 of lower control line connector 86 to form a downhole, control line connection. The connection provides a continuous communication path along system 30 by coupling control line segments 88 and 94. The movement of piston 126 also expands a locking ring 128 on the upper connector system 74 into a profile 129 on the lower assembly 78. Locking ring 128 axially retains the upper connector system 74 in contact with the lower assembly 78 after pressure is withdrawn from piston chamber 124.

Figure 8:
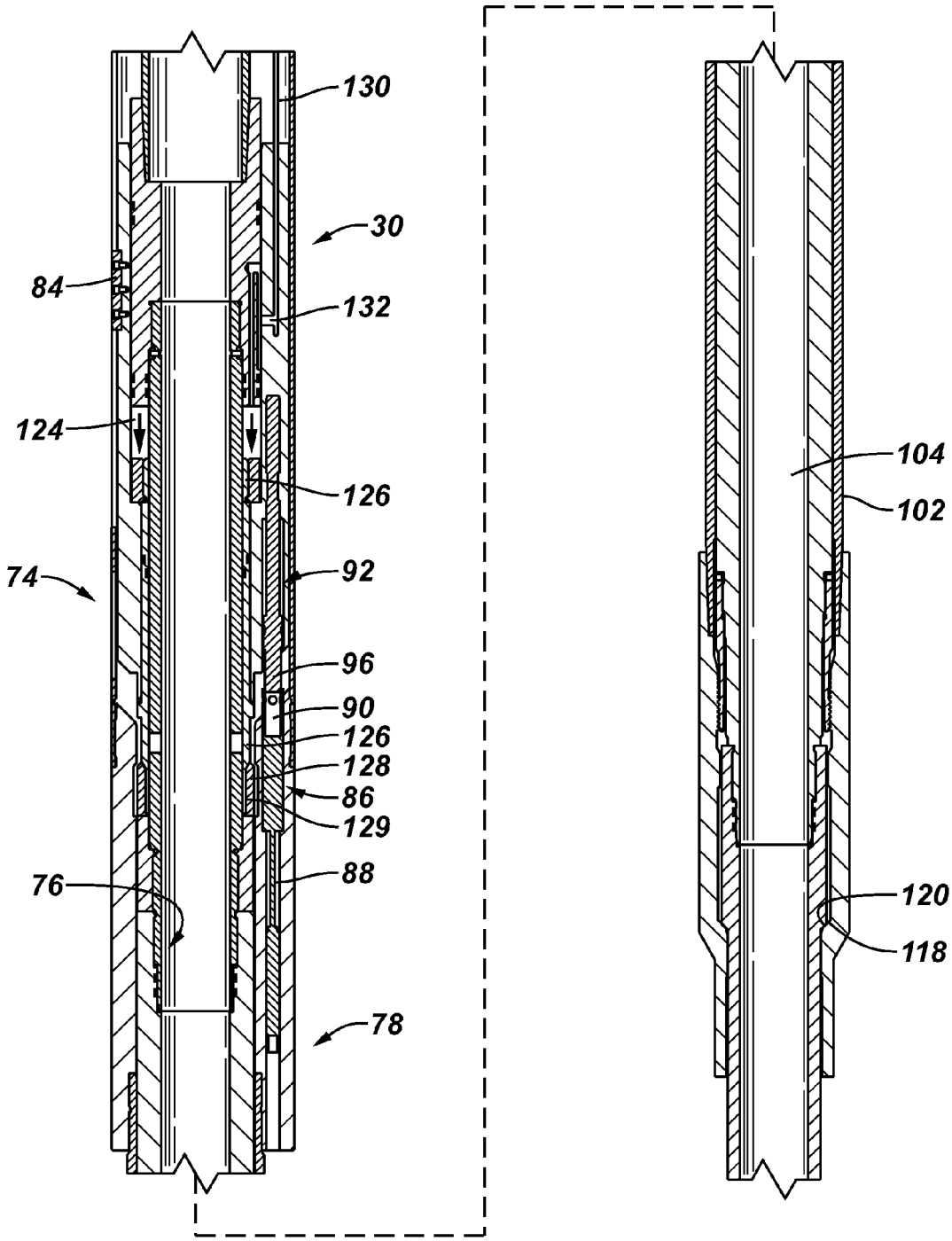
FIG. 8 is another illustration of an upper well equipment assembly being engaged with a lower well equipment assembly, according to another embodiment of the present invention.
Figure 9:
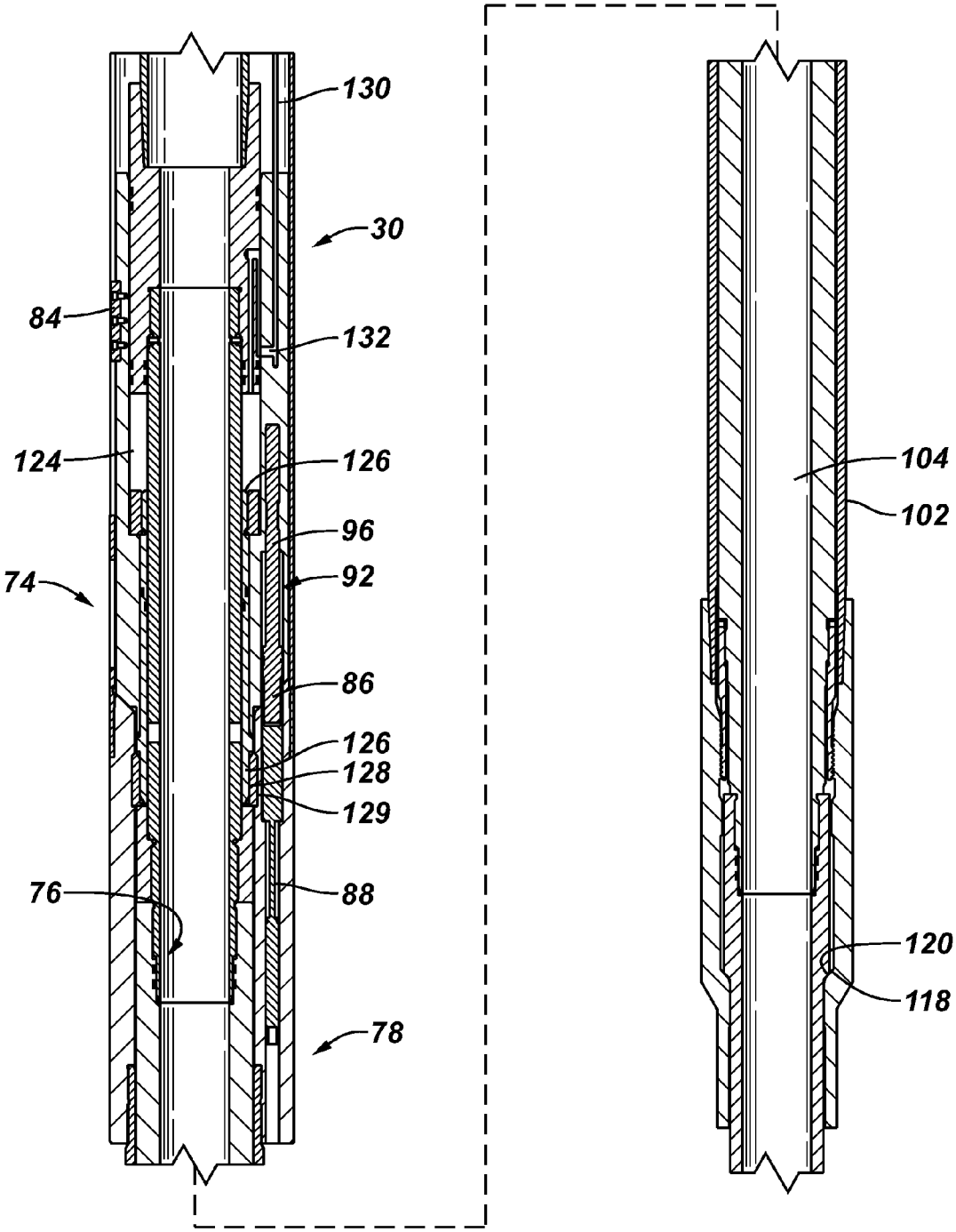
FIG. 9 is an illustration of the upper well equipment assembly of FIG. 8 fully engaged with the lower well equipment assembly, according to an embodiment of the present invention.

Another mechanism and methodology for moving upper control line connector 92 and lower control line connector 86 into engagement utilizes a control line 130, as illustrated in FIG. 8. This embodiment is very similar to the embodiment described with reference to FIGS. 6 and 7 however control line 130 is used to direct pressurized fluid to piston chamber 124 via flow passages 132. Again, upon application of sufficient pressure, piston 126 is able to move upper control line connector 92 into engagement with lower control line connector 86, as illustrated best in FIG. 9. Control line 130 also can be used as one of the primary control lines for communicating signals downhole or uphole once connectors 92 and 86 are joined. This can eliminate the need for an additional, separate control line to direct pressurized fluid to piston chamber 124.

According to one example, operation of connection system 74 comprises initially running lower assembly 78 into wellbore 34 and deploying the lower assembly at a desired wellbore location. Subsequently, upper assembly 76 is run downhole such that tubing 102 enters receptacle 80. Alignment key 84 contacts alignment receiver 82 and rotationally aligns upper assembly 76 with lower assembly 78 to enable coupling of connectors 86 and 92. Movement of upper assembly 76 is restrained by latch mechanism 106 engaging collet 112. While restrained, a cleaning fluid or gel is pumped from the surface via tubing 102 and through cleanout ports 100 to remove debris from receptacle 90 and the surrounding connector region into the well via the debris ports 107. Once the area is cleaned, collet 112 is pushed past latching mechanism 106 and into the second latch mechanism 114 until shoulder 120 engages shoulder 118. At this point, upper assembly 76 is fully engaged with lower assembly 78 and the connectors 86 and 92 are aligned for coupling. Pressure is then applied via tubing 102 or control line 130 to move piston 126. The movement of piston 126 drives extension 96 of upper control line connector 92 into receptacle 90 of lower control line connector 86 to fully engage or mate the connectors at the downhole location.

At various locations along system 30, it may be desirable to secure the one or more control lines or control line segments.

Figure 10:
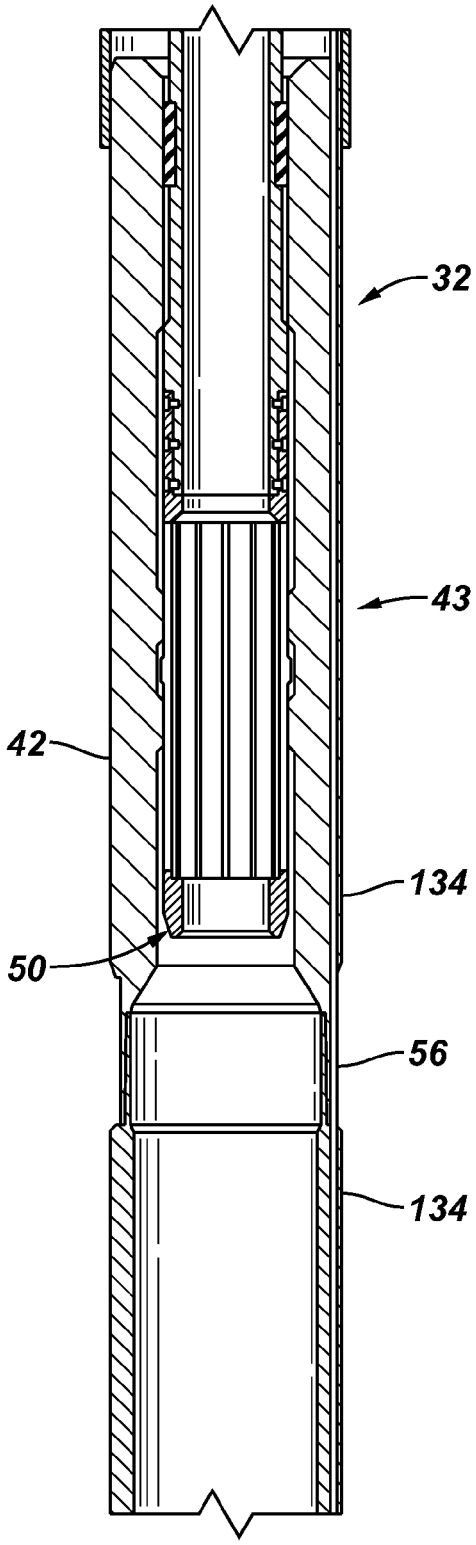
FIG. 10 is a cross-sectional view of a control line retention system, according to an embodiment of the present invention.
Figure 11:
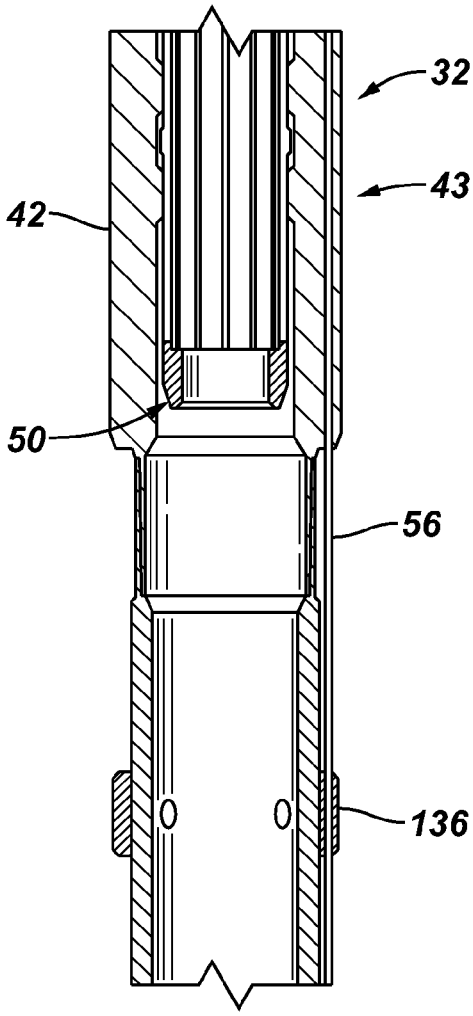
FIG. 11 is a cross-sectional view of another control line retention system, according to an embodiment of the present invention.

The control lines can be secured by a variety of mechanisms, examples of which are illustrated in FIGS. 10 and 11. For purposes of explanation, the securing techniques are illustrated in conjunction with contraction joint 32, however these techniques can be utilized along other sections on system 30. In FIG. 10, a recessed slot 134 is formed into an outside diameter of the system component, e.g. contraction joint 32. A control line, such as control line 56, is positioned within recessed slot 134 and is thus held in place and protected in the downhole environment. The control line may comprise a fiber optic line or other suitable control line extending along system 30. Furthermore, individual control lines or a plurality of control lines can be positioned in each recessed slot 134, or a plurality of recessed slots 134 can be formed for additional control lines. Another embodiment is illustrated in FIG. 11 in which clamps 136 are used to secure the control line along a component of system 30, e.g. control line 56 along contraction joint 32. Again, the control line may comprise one or more control lines in the form of, for example, fiber-optic cables, electric lines, fluid lines or other suitable control lines.

Figure 12:
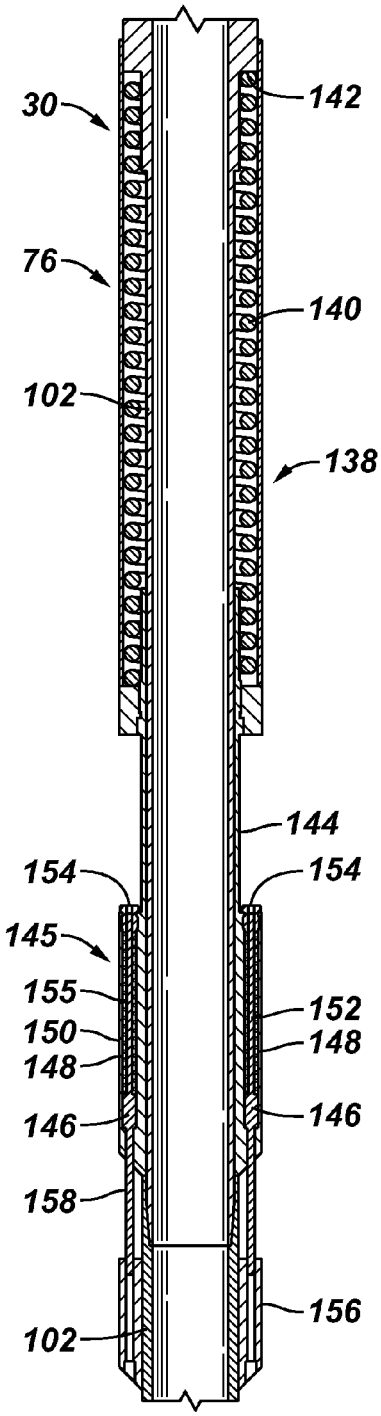
FIG. 12 is a generally axial cross-sectional view of an engagement mechanism to facilitate coupling of connectors downhole, according to an embodiment of the present invention.
Figure 13:
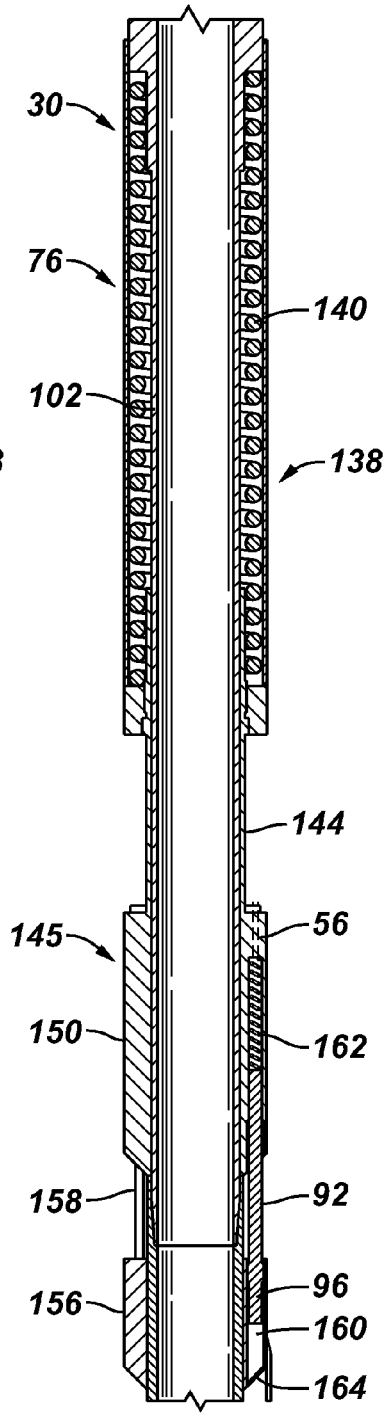
FIG. 13 is a view similar to that of FIG. 12 but from a different angle, according to an embodiment of the present invention.
Figure 14:
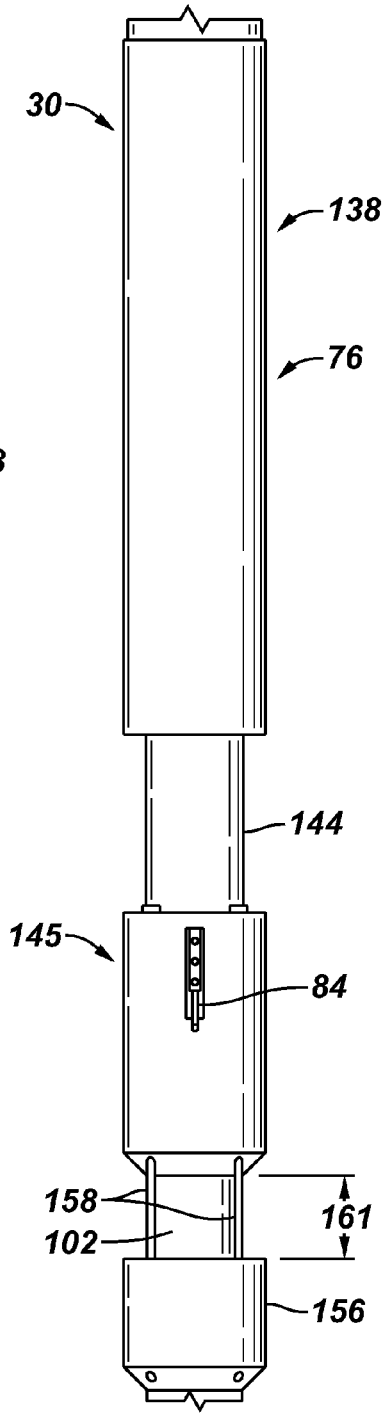
FIG. 14 is a view similar to that of FIG. 12 but showing an exterior of the engagement mechanism, according to an embodiment of the present invention.

Connector mechanism 74 also can be designed for coupling upper control line connector 92 and lower control line connector 86 via other types of mechanisms, such as a spring mechanism 138, as illustrated in FIGS. 12 through 14. In this embodiment, spring mechanism 138 is mounted on upper assembly 76 and comprises a spring 140 positioned between a shoulder 142 of tubing 102 and a housing 144 carrying upper control line connector 92. In some embodiments, the control line connectors are coupled followed by compression of spring 140 to fully land upper assembly 76 into lower of assembly 78. Spring 140 also can provide some cushion for the control line connectors while biasing upper control line connector 92 into engagement with lower control line connector 86. In some embodiments, spring 140 may be preloaded.

In addition to spring mechanism 138 or as an alternative to spring mechanism 138, connector mechanism 74 also may comprise a soft landing system 145. The soft landing system 145 allows the upper assembly 76 to land in the lower assembly 78 in conjunction with a soft, controlled coupling of the upper control line connector 92 with the corresponding lower control line connector 86. As illustrated best in FIG. 12, one embodiment of soft landing system 145 comprises one or more soft landing pistons 146 each slidably mounted in a cylinder 148 formed in an expanded region 150 of housing 144. Each soft landing piston 146 is connected to a soft land rod 152 extending through cylinder 148 and slidably received in a corresponding rod opening 154 formed in housing 144. A spring 155 may be positioned around rod 152 within cylinder 148 to bias piston 146. Additionally, cylinder 148 may be provided with a fluid, such as a hydraulic fluid, to dampen the movement of piston 146 along cylinder 148. As each piston 146 is moved along cylinder 148, the hydraulic fluid is forced past the piston in a direction opposite to the direction of piston movement and into cylinder 148 on an opposite side of the piston. This forced migration of hydraulic fluid provides a dampening effect that facilitates a smooth and secure mating of the upper control line connector 92 with the lower control line connector 86, as discussed in greater detail below.

Each piston 146 also is connected to a traveling ring 156 which is slidable along the exterior of tubing 102. Pistons 146 may be connected to traveling ring 156 by rods 158, as further illustrated in the exterior view of FIG. 14. The traveling ring 156 may comprise one or more longitudinal passageways or ports 160 for slidably receiving therein one or more corresponding stinger style extensions 96 of control line connectors 92, as illustrated best in the cross-sectional view of FIG. 13. Each stinger style extension 96 is mounted in expanded region 150 of housing 144 and is moved through its corresponding port 160 when traveling ring 156 is forced into closer proximity with expanded region 150 of housing 144, i.e. when the gap 161 illustrated in FIG. 14 closes. Optionally, the extensions 96 may be spring mounted via springs 162 that help compensate for tolerancing issues during engagement of the upper control line connector 92 with the lower control line connector 86. Diaphragms or other covers 164 also can be positioned in each port 160 to prevent the incursion of debris or other contaminants into upper control line connector 92.

Figure 15:
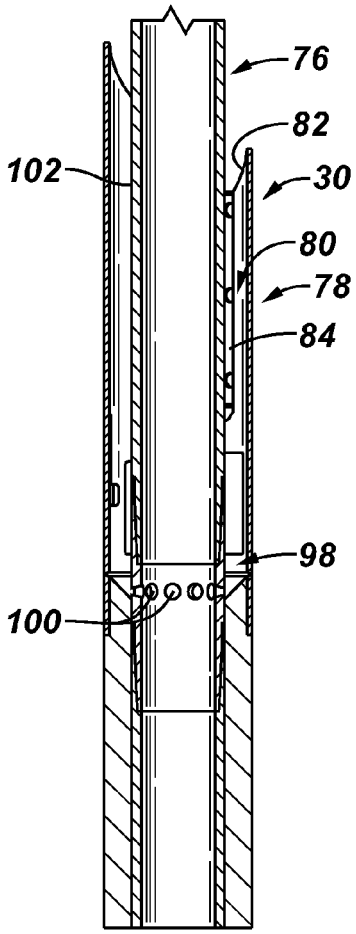
FIG. 15 is a generally axial cross-sectional view of a flushing system for cleaning out a region of the completion, according to an embodiment of the present invention.
Figure 16:
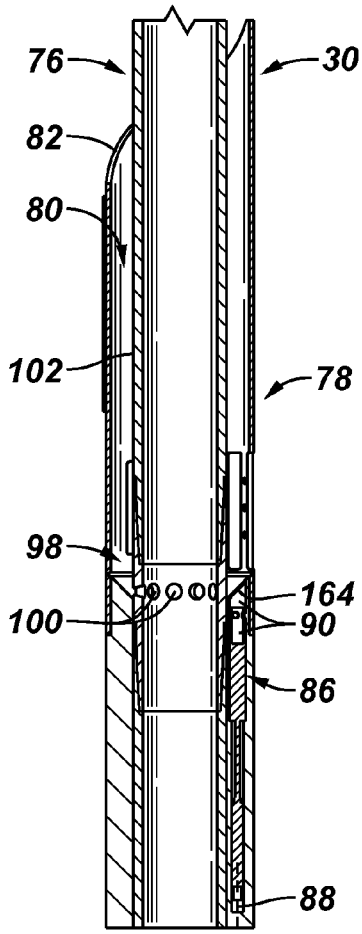
FIG. 16 is a view similar to that of FIG. 15 but from a different angle, according to an embodiment of the present invention.
Figure 17:
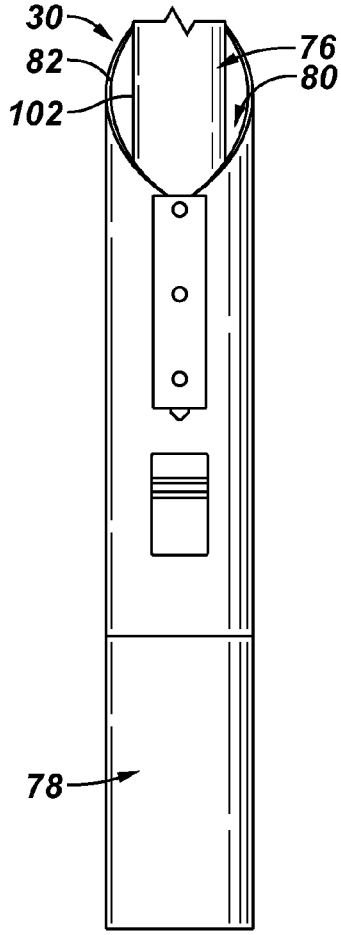
FIG. 17 is a view similar to that of FIG. 15 but showing an exterior of the downhole assemblies, according to an embodiment of the present invention.

Referring generally to FIGS. 15 through 17, various views are provided of lower assembly 78 receiving the upper assembly 76 in which a soft landing system 145 has been incorporated. As described with respect to embodiments set forth above, lower assembly 78 may comprise an alignment receiver 82 positioned to engage the alignment key 84 of upper assembly 76 to rotationally orient upper control line connector 92 with respect to lower control line connector 86. Additionally, the soft landing system 145 can be used in conjunction with the flushing system 98 and latch mechanism 106 to position flushing ports 100 proximate a desired region, such as proximate lower control line connector 86, as illustrated in FIGS. 15 and 16. As illustrated best in FIG. 16, diaphragms or covers 164 also can be positioned in lower assembly 78 to block the influx of debris or other contaminants into receptacle 90 of lower control line connector 86.

Figure 18:
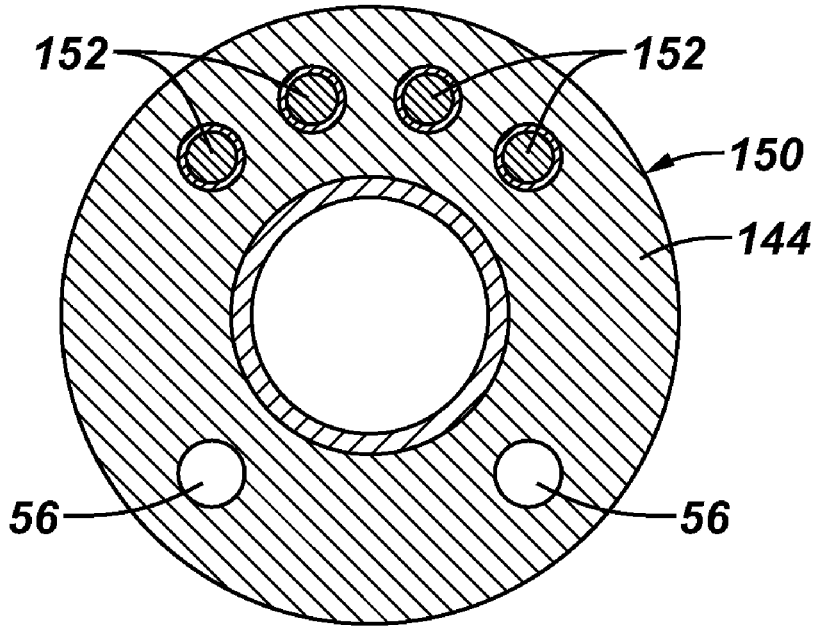
FIG. 18 is a lateral cross-sectional view of the engagement mechanism, according to an embodiment of the present invention.
Figure 19:
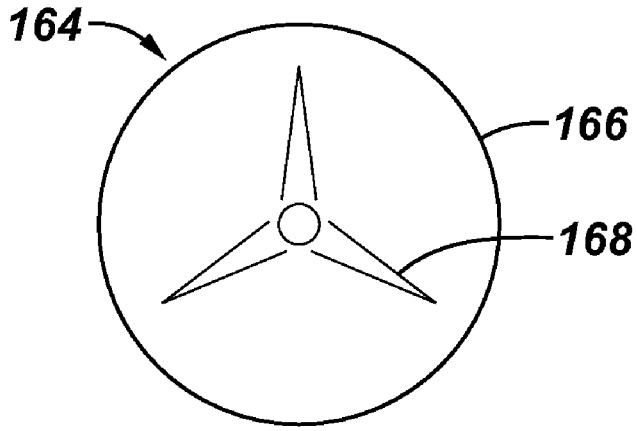
FIG. 19 is top view of a temporary cover used to cover a control line connector, according to an embodiment of the present invention.

Depending on the specific wellbore application, the number of control lines 56 and the number of soft landing pistons 146 and associated rods can vary substantially. In one example, as illustrated in FIG. 18, connection system 74 and soft landing system 145 employ two separate control lines 56 and four sets of pistons 146 and soft landing rods 152. Similarly, a variety of optional covers 164 can be positioned to prevent contamination of the connectors with debris or other contaminants. As illustrated in FIG. 19, each cover 164 may be formed as a diaphragm 166 having score lines 168. The score lines 168 enable each extension 96 of upper control line connectors 92 to break through covers 164 and form a connection with lower control line connector 86 without creating separated cover pieces that could interfere with the connection and operation of the downhole connectors.

Figure 20:
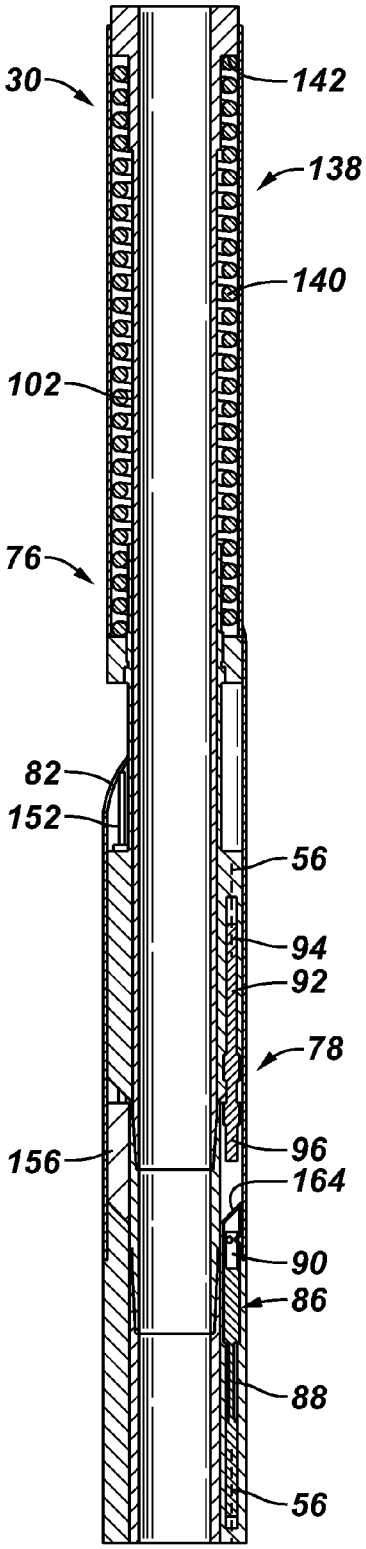
FIG. 20 is a generally axial cross-sectional view of the engagement mechanism of an upper well equipment assembly engaged with a lower well equipment assembly, according to an embodiment of the present invention.
Figure 21:
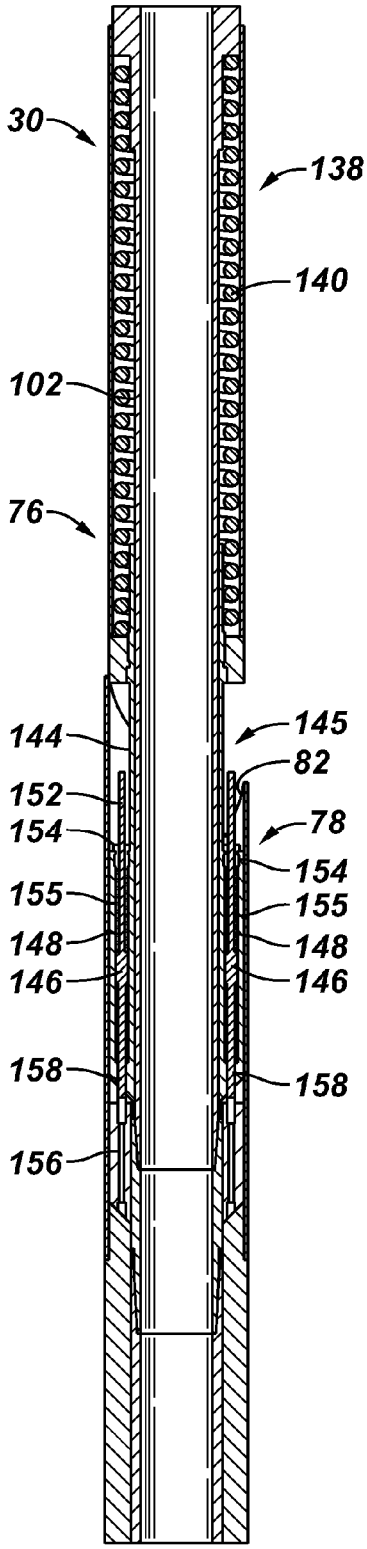
FIG. 21 is a view similar to that of FIG. 20 but from a different angle, according to an embodiment of the present invention.
Figure 22:
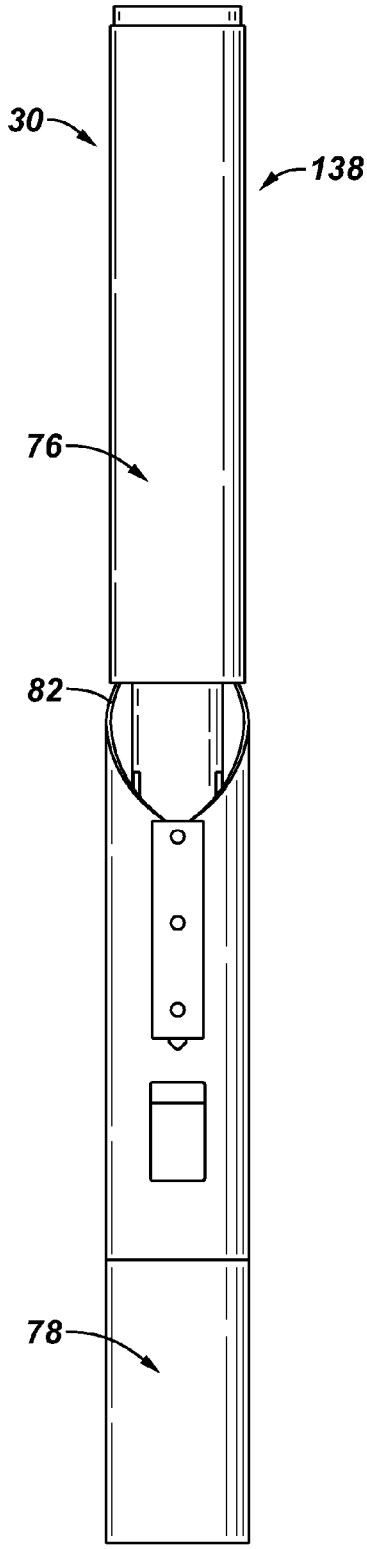
FIG. 22 is a view similar to that of FIG. 20 but showing an exterior of the engaged upper and lower well equipment assemblies, according to an embodiment of the present invention.
Figure 23:
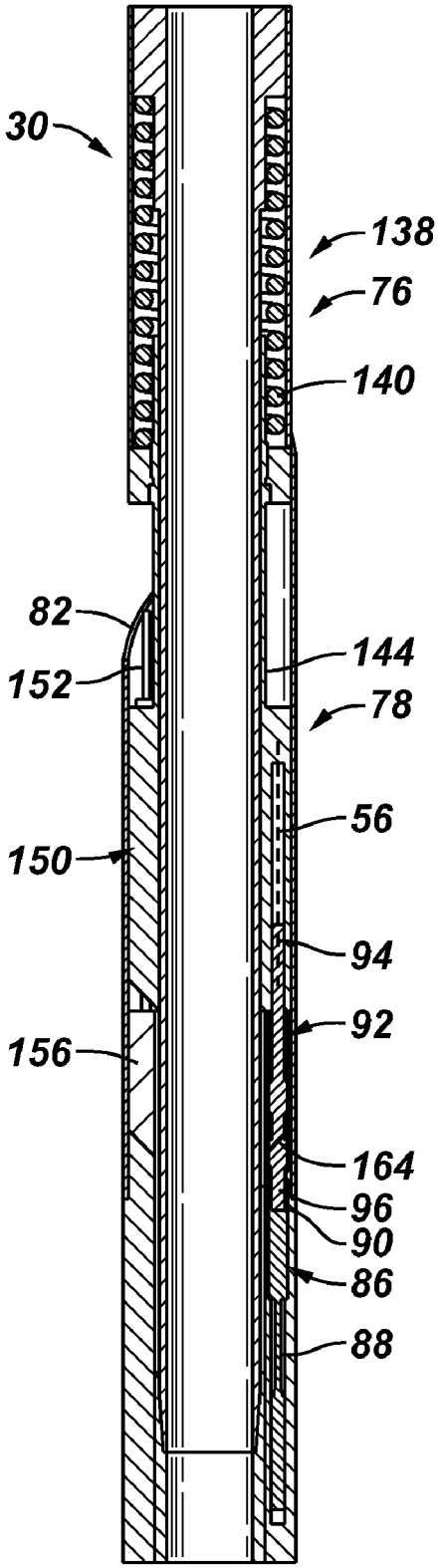
FIG. 23 is a view similar to that of FIG. 20 but showing the engagement mechanism fully actuated to engage the upper assembly connectors with the lower assembly connectors, according to an embodiment of the present invention.

When the connection region is flushed and upper assembly 76 is moved further into lower assembly 78, traveling ring 156 engages lower assembly 78, as illustrated in FIGS. 20 through 22. At this point, soft landing system 145 slows or dampens the movement of upper assembly 76 and upper control line connector or connectors 92 toward the corresponding lower control line connectors 86. This ensures that extension 96 of upper control line connector 92 moves toward receptacle 90 of lower control line connector 86 and a through any debris covers 164 in a controlled manner, as illustrated best in FIG. 20. The soft landing system pistons 146 cooperate with their corresponding springs 155 and the hydraulic dampening fluid within cylinders 148 to dampen and control the movement of upper connectors 92 towards lower connectors 86, as illustrated in FIGS. 21 and 22. Ultimately, the upper control line connectors 92 progress through debris covers 164 and move into engagement with their corresponding lower control line connectors 86 to complete the soft landing and form the downhole control line connection, as illustrated best in FIG. 23.

In applications using both spring mechanism 138 and soft landing system 145, one example of a landing sequence is as follows. Initially, traveling ring 156 is brought into contact with lower assembly 78. The main spring 140 is then compressed to land the upper assembly 76 into lower assembly 78.

Subsequently, the movement of traveling ring 156 is controlled by pistons 146 to engage upper control line connector 92 with lower control line connector 86 in a controlled manner. The maximum force applied to connectors 92 and 86 can be determined by selecting appropriate spring rates for the various springs acting on the connectors. Additionally, the speed at which the connection is formed can be predetermined by selecting, for example, piston size, corresponding cylinder bore size and the viscosity of hydraulic fluid deployed within cylinders 148.

Figure 24:
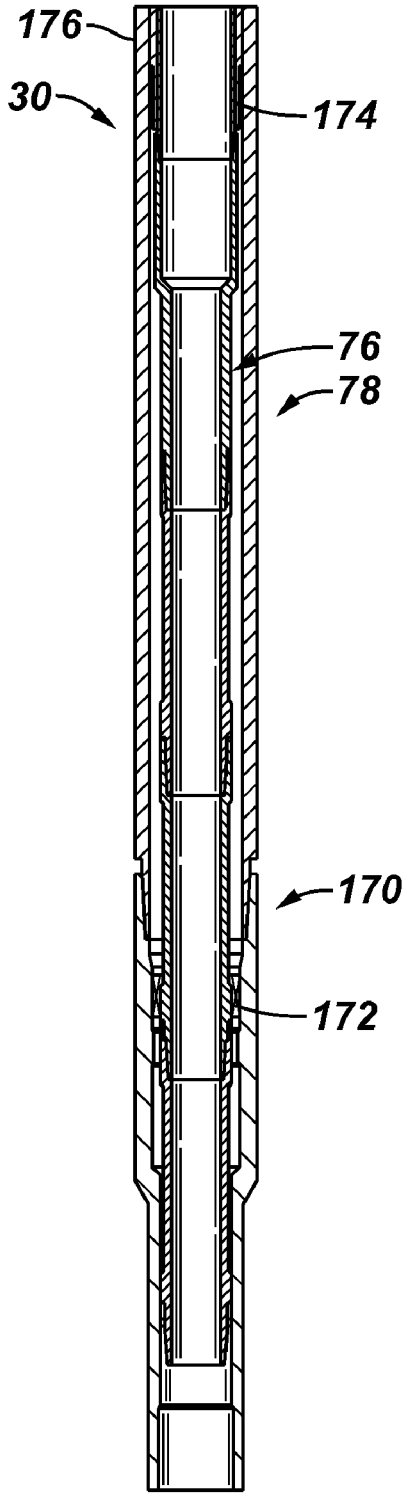
FIG. 24 is a generally cross-sectional view of a latch mechanism to hold the upper well equipment assembly in a fully engaged position relative to the lower well equipment assembly, according to an embodiment of the present invention

Regardless of whether the control line connections are formed with the aid of spring mechanism 138, soft landing system 145 or an active connection system, such as that illustrated in FIGS. 5 through 9, an additional downhole retention mechanism 170 can be used to secure upper assembly 76 to lower assembly 78 upon full engagement of the upper and lower assemblies, as illustrated in FIG. 24. In this example, lower assembly 78 comprises a lower latch profile 172 positioned below the one or more lower control line connectors 86. The lower latch profile 172 is designed to engage a corresponding profile 174 located on a lower portion of upper assembly 76. By way of example, corresponding profile 174 may be provided by a collet 176.

Figure 25:
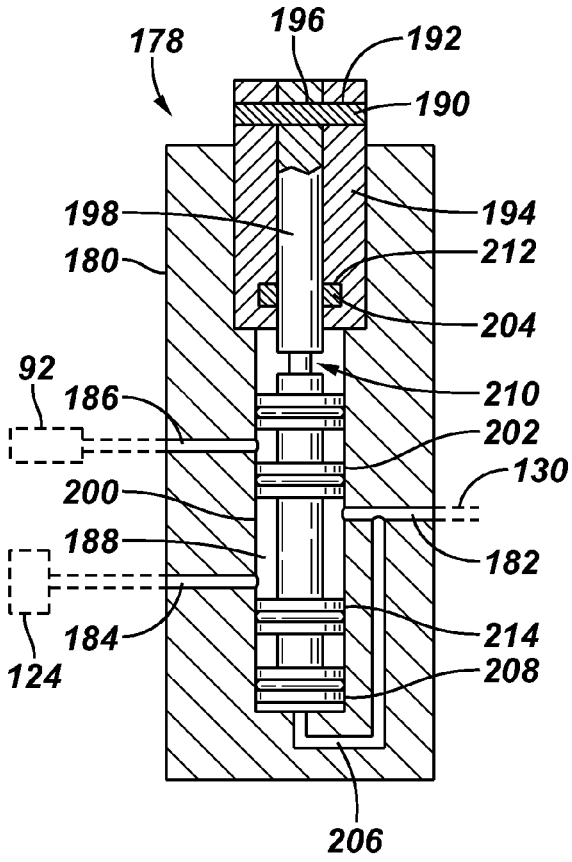
FIG. 25 is a schematic illustration of a control line isolation mechanism that may be combined with a downhole equipment assembly, according to an embodiment of the present invention.
Figure 26:
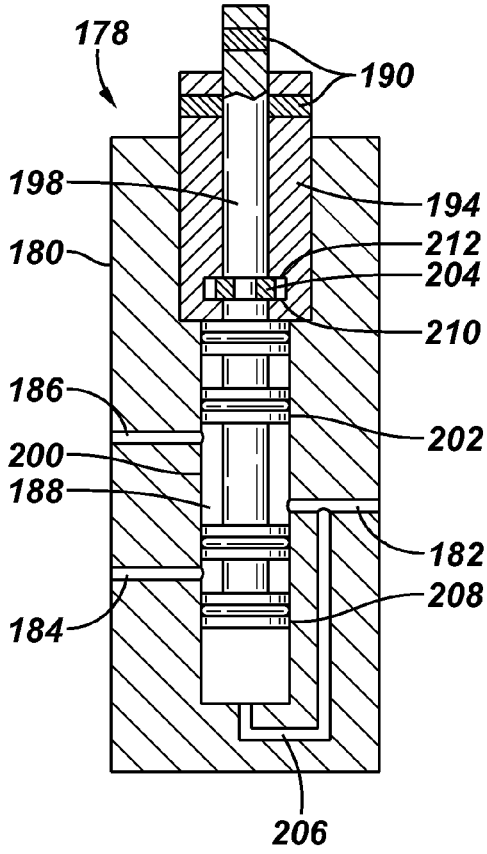
FIG. 26 is a view similar to FIG. 25 but showing the control line isolation mechanism actuated to another state of operation, according to an embodiment of the present invention.

Referring generally to FIGS. 25 and 26, an embodiment of a control line isolation mechanism 178 is illustrated. The control line isolation mechanism 178 enables the use of an individual control line for supplying pressurized fluid to piston chamber 124 and for communicating signals downhole and/or uphole once connectors 92 and 86 are joined, as discussed briefly above with respect to FIGS. 6-9. In the example illustrated in FIG. 25, control line isolation mechanism 178 is attached to upper assembly 76 and comprises a body 180 that may be attached to or formed as an integral part of upper assembly 76. The control line isolation mechanism 178 is used to prevent communication from control line 130 to upper control line connector 92 until after upper control line connector 92 is fully engaged with lower control line connector 86.

In the illustrated embodiment, body 180 comprises a passageway 182 hydraulically connected to control line 130. Body 180 also comprises a passageway 184 hydraulically connected to piston chamber 124 and a passageway 186 hydraulically connected to upper control line connector 92. Within body 180, a piston/rod assembly 188 is slidably mounted to control the communication of fluids and pressure between passageway 182 and passageways 184, 186.

When upper assembly 76 is run downhole, control line isolation mechanism 178 is in the configuration illustrated in FIG. 25. In this configuration, a shear pin 190 is engaged in a bore 192 within a retainer 194, and shear pin 190 also is engaged in a bore 196 through a rod 198 which forms a part of piston/rod assembly 188. Retainer 194 is engaged with body 180 by, for example, a threaded engagement, and shear pin 190 locks piston/rod assembly 188 to retainer 194 to prevent axial movement during run in. In this configuration, passageway 182 is hydraulically connected to passageway 184 via a bore 200 in body 180. However, passageway 182 is isolated from passageway 186 by a piston member 202 which also is part of piston/rod assembly 188. A snap ring 204 is held in a radially expanded position by rod 198, as illustrated.

Once connectors system 74 is positioned at second latch mechanism 114, upper control line connector 92 can be brought into engagement with lower control line connector 86 by applying pressure to control line 130, through passageway 182, through bore 200, through passageway 184 and into piston chamber 124. Another passageway 206 also directs the pressurized fluid from passageway 182 to act against a piston 208 of piston/rod assembly 188. The pressure against piston 208 causes a force to be applied against shear pin 190 via rod 198. The material and geometry of shear pin 190 is selected so that it shears when piston 208 is exposed to a pressure above that which is required to completely engage upper control line connector 92 and lower control line connector 86. After shear pin 190 shears, pressure in passageway 206 further acts against piston 208 and moves piston/rod assembly 188 to the position illustrated in FIG. 26.

When control line isolation mechanism 178 is in the configuration illustrated in FIG. 26, snap ring 204 has collapsed radially into a groove 210 in rod 198 while still engaging a groove 212 in retainer 194. By simultaneously engaging grooves 210 and 212, snap ring 204 locks piston/rod assembly 188 into the actuated position and prevents further axial movement. In this position, a piston 214 isolates passageway 182 from passageway 184 and traps the actuated pressure in piston chamber 124. Piston 208 continues to isolate passageway 206 from passageway 184, and bore 200 hydraulically connects passageway 182 with passageway 186. Thus, communication is provided from control line 130 through passageway 182, through bore 200, through passageway 186, through upper control line connector 92 and lower control line connector 86, and to the lower control line 88. In this position, control line 130 is hydraulically connected to control line 88 and isolated from piston chamber 124.

It should be noted that the embodiments described above provide examples of the unique downhole connection system and methodology for forming downhole connections. However, the system can be used in a variety of well environments and in a variety of wellbore operations. Accordingly, the specific components used and the procedural steps implemented in forming the downhole connections can be adjusted to accommodate the different environments and applications. For example, the upper and lower assemblies may comprise a variety of different components used in various wellbore operations, including drilling operations, well treatment operations, production operations and other well related operations. Additionally, the components, size and orientation of the control line connectors can be changed or adjusted to suit a particular well operation.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A wellbore system, comprising:

a lower assembly that can be positioned in a wellbore, the lower assembly having:

a lower control line connector;

a first latch mechanism; and a second latch mechanism longitudinally spaced from the first latch mechanism; and an upper assembly engageable with the lower assembly, the upper assembly having:

an upper control line connector; and a clean out port;

the upper assembly being held in a first position by the first latch mechanism while flushing fluid is moved through the clean out port to flush at least one of the lower and upper control line connectors; and the upper assembly being held in a second position by the second latch mechanism during engagement of the upper control line connector with the lower control line connector.

2. The wellbore system as recited in claim 1, wherein the lower assembly further comprises an alignment receiver to rotationally align the upper assembly with the lower assembly; and wherein the upper assembly comprises an alignment key for receipt in the alignment receiver.

3. The wellbore system as recited in claim 1, wherein the upper assembly comprises a collet located to sequentially engage the first latch mechanism and the second latch mechanism.

4. The wellbore system as recited in claim 1, wherein the lower control line connector and the upper control line connector consist of one of: fiber optic connectors and electrical connectors.

5. The wellbore system as recited in claim 1, further comprising a mechanism to engage the upper control line connector with the lower control line connector after the upper assembly is positioned by the second latch mechanism.

6. The wellbore system as recited in claim 1, wherein the upper assembly comprises two collets located to sequentially engage the first latch mechanism and the second latch mechanism.

7. A method, comprising:

running an upper assembly downhole until an upper assembly engagement portion engages with a latch mechanism of a lower assembly;

pumping a fluid through a clean out port of the upper assembly to clean a control line connector region;

moving the upper assembly past the latch mechanism; and engaging an upper control line connector of the upper assembly with a lower control line connector of the lower assembly.

8. The method as recited in claim 7, wherein pumping comprises pumping a cleaning fluid through the control line connector region.

9. A method as recited in claim 7, wherein moving comprises moving the upper assembly engagement portion into engagement with the second latch mechanism.

10. The method as recited in claim 9, wherein engaging comprises engaging the upper control line connector with lower control line connector after the upper assembly engagement portion is moved into engagement with the second latch mechanism.

11. The method as recited in claim 7, wherein engaging comprises moving the upper control line connector via a piston actuated by pressure within a tubing of the upper assembly.

12. The method as recited in claim 7, wherein engaging comprises moving the upper control line connector via a piston actuated by pressure within a fluid control line extending along the upper assembly.

13. The method as recited in claim 7, further comprising a fluid control line coupled to the upper control line connector, wherein the fluid control line is used to actuate a piston to connect the upper control line connector with the lower control line connector and to supply communication downhole following connection of the upper and lower control line connectors; and wherein the fluid control line to actuate the piston is hydraulically isolated from the upper control line connector until after the upper control line connector is engaged with the lower control line connector.

14. A method, comprising:

stabbing an upper assembly into a lower assembly positioned in a wellbore;

restraining movement of the upper assembly with a downhole mechanism while a completion preparation procedure is carried out; and subsequently moving the upper assembly the upper assembly into full engagement with the lower assembly.

15. The method as recited in claim 14, wherein restraining comprises restraining movement of the upper assembly while a flushing fluid is pumped through the upper assembly to clean a control line connection region.

16. The method as recited in claim 15, further comprising moving an upper control line connector into engagement with a lower control line connector following flushing of the control line connector region, the upper control line connector being moved by a piston under pressure.

17. The method as recited in claim 15, further comprising moving a plurality of upper control line connectors into engagement with a plurality of lower control line connectors following flushing of the control line connector region, the upper control line connectors being moved by a piston under pressure.

18. The method as recited in claim 14, wherein subsequently moving comprises moving the upper assembly from engagement with a first latch mechanism into engagement with a second latch mechanism.

19. The method as recited in claim 14, further comprising coupling a pair of control line connectors in the control line connection region following the subsequent movement of the upper assembly into full engagement with the lower assembly.

20. A system, comprising:

an upper assembly;

a lower assembly deployable in a wellbore, the lower assembly having a plurality of latch mechanisms for selectively restraining movement of the upper assembly during engagement with the lower assembly;

flushing system oriented to flush a specific region of the lower assembly while the upper assembly is restrained at a first latch mechanism of the plurality of latch mechanisms; and moving the upper assembly to another latch mechanism of the plurality of latch mechanisms.

21. The system as recited in claim 20, wherein the flushing system comprises a tubing extending to a plurality of ports in the upper assembly.

22. The system as recited in claim 20, wherein the upper assembly comprises a collet sized to engage the plurality of latch mechanisms.

23. The system as recited in claim 20, wherein the upper assembly comprises a plurality of collets sized to engage the plurality of latch mechanisms.

24. The system as recited in claim 20, wherein the upper assembly comprises an upper control line connector and the lower assembly comprises a lower control line connector designed to receive the upper control line connector.

25. The system as recited in claim 20, wherein the upper assembly comprises a plurality of upper control line connectors and the lower assembly comprises a plurality of lower control line connectors designed to receive the upper control line connectors.

* * * * *